US006775388B1

(12) United States Patent
Pompei

(10) Patent No.: US 6,775,388 B1
(45) Date of Patent: Aug. 10, 2004

(54) ULTRASONIC TRANSDUCERS

(75) Inventor: F. Joseph Pompei, Somerville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/300,200

(22) Filed: Apr. 27, 1999

Related U.S. Application Data

(63) Continuation-in-part of application No. 09/116,271, filed on Jul. 16, 1998.

(51) Int. Cl.[7] ..... H04R 25/00
(52) U.S. Cl. ..... 381/191; 367/181
(58) Field of Search ..... 381/190, 191, 381/173, 174; 367/140, 180, 181

(56) References Cited

U.S. PATENT DOCUMENTS

| | | | | | |
|---|---|---|---|---|---|
| 3,816,671 | A | | 6/1974 | Fraim et al. | 179/111 E |
| 3,908,098 | A | | 9/1975 | Kawakami et al. | 179/111 |
| 4,081,626 | A | | 3/1978 | Muggli et al. | 179/111 R |
| 4,190,818 | A | | 2/1980 | Follin et al. | 367/138 |
| 4,404,489 | A | | 9/1983 | Larson, III et al. | 310/334 |
| 4,492,825 | A | * | 1/1985 | Brzezinski et al. | 381/113 |
| 4,607,145 | A | | 8/1986 | Ravinet et al. | 179/110 A |
| 4,695,986 | A | | 9/1987 | Hossack | 367/140 |
| 4,823,908 | A | | 4/1989 | Tanaka et al. | 181/175 |
| 4,887,248 | A | | 12/1989 | Griebeler | 367/181 |
| 4,963,782 | A | | 10/1990 | Bui et al. | 310/358 |
| 5,161,128 | A | * | 11/1992 | Kenney | 367/181 |
| 5,287,331 | A | | 2/1994 | Schindel et al. | 367/140 |
| 5,321,332 | A | | 6/1994 | Toda | 310/322 |
| 5,488,954 | A | | 2/1996 | Sleva et al. | 128/662.03 |
| 5,539,705 | A | | 7/1996 | Akerman et al. | 367/132 |
| 5,600,610 | A | | 2/1997 | Hill et al. | 367/181 |
| 5,745,438 | A | * | 4/1998 | Hill et al. | 367/181 |
| 5,859,915 | A | | 1/1999 | Norris | 381/75 |
| 5,885,129 | A | | 3/1999 | Norris | 446/405 |
| 6,044,160 | A | * | 3/2000 | Norris | 381/191 |

FOREIGN PATENT DOCUMENTS

| | | | |
|---|---|---|---|
| EP | 0 420 500 A2 | 3/1991 | |
| GB | 1 234 767 | 6/1971 | |
| GB | 2151025 | 7/1985 | H04R/1/40 |
| JP | 59171300 | 9/1984 | |
| JP | 06161476 | 6/1994 | G10K/11/26 |
| JP | 08149592 | 6/1996 | H04R/3/00 |

OTHER PUBLICATIONS

European Patent Office: Communication pursuant to Article 96(2) EPC; Applicant: Massachusetts Institute of Technology; Application No. 99 305 632.4–2213, Ref. D037395PEP, dated Apr. 30, 2003.

(List continued on next page.)

*Primary Examiner*—Minsun Oh Harvey
*Assistant Examiner*—Brian Pendleton
(74) *Attorney, Agent, or Firm*—Testa, Hurwitz & Thibeault, LLP

(57) ABSTRACT

Sonic transducers utilize resonant cavities of varying depths to achieve wide operational bandwidth. The transducers may include a conductive membrane spaced apart from one or more backplate electrodes. In one approach, spacing is achieved using a dielectric spacer having a series of depressions arranged in a pattern, the depressions forming cavities each resonant at a predetermined frequency. In another approach, the conductive membrane is piezoelectrically active, and the transducer is simultaneously driven in both piezoelectric and electrostatic modes.

20 Claims, 6 Drawing Sheets

OTHER PUBLICATIONS

European Patent Office: Communication pursuant to Article 96(2) EPC; Applicant: Massachusetts Institute of Technology; Application No. 99 305 632.4–1240, Ref. D037395PEP, dated Jul. 25, 2002.
Yoneyama et al., *J. Acoust. Soc. Am.*, 73(5),1532–1536 (1983).
Mattila et al., Sensors and Actuaters A, 45, 203–208 (1994).
Bass et al., *J. Acoust. Soc. Am.*, 88(4), 2019–2021 (1990).
Bass et al., *J. Acoust. Soc. Am.*, 97(1), 680–683 (1995).
Biber et al., "The Polaroid Ultrasonic Reanging System," *67th Conv. of Audio Eng. Soc.* (1980).
Piquette, *J. Acoust. Soc. Am.*, 98(1), 422–430 (1995).
Suzuki et al., *IEEE Trans. Ultrason, Ferroel, and Freq. Cont.*, 36(6), 620–627 (1989).
Manthey et al., *Meas. Sci. Technol. 3*, at 249–261 (1992).
Carr, *Ultrasonics 1993*, 31(1), 13–20 (1993).

* cited by examiner

ULTRASONIC TRANSDUCERS

RELATED APPLICATION

This is a continuation-in-part of U.S. Ser. No. 09/116,271, filed on Jul. 16, 1998.

FIELD OF THE INVENTION

This invention relates to the transmission of sonic signals, and more specifically, to transducers for transmitting such signals through the air.

BACKGROUND OF THE INVENTION

Ultrasonic signals are sound waves of frequencies above the audible range (generally 20 kHz). Many, if not most applications involving ultrasound require generation of a well-defined beam. Accordingly, ultrasonic transducers—which convert electrical signals into corresponding acoustic signals—should have highly directional transmission characteristics in addition to high conversion efficiency. Furthermore, the mechanical impedance of the transducer should match, as closely as practicable, the impedance of the propagation medium.

Two important classes of ultrasound transducer for transmission through air are electrostatic and piezoelectric crystal devices. In an electrostatic transducer, a thin membrane is vibrated by the capacitive effects of an electric field, while in a piezoelectric transducer, an applied potential causes the piezo ceramic material to change shape and thereby generate sonic signals. Both types of transducer exhibit various performance limitations, which can substantially limit their usefulness in certain applications. In particular, these performance limitations have inhibited the development of parametric loud-speakers, i.e., devices that produce highly directional audible sound through the nonlinear interaction of ultrasonic waves. In a parametric system, a high-intensity ultrasonic signal that has been modulated with an audio signal will be demodulated as it passes through the atmosphere—a nonlinear propagation medium—thereby creating a highly directional audible sound.

Piezoelectric transducers generally operate at high efficiency over a limited bandwidth. In parametric applications the degree of distortion present in the audible signal is directly correlated with the available bandwidth of the transducer, and as a result, the use of a narrowband (e.g., piezoelectric) transducer will result in sound of poor quality. Piezoelectric transducers also tend to have high acoustic impedances, resulting in inefficient radiation into the atmosphere, which has a low impedance. Because of this mismatch, most of the energy applied to the transducer is reflected back into the amplifier (or into the transducer itself), creating heat and wasting energy. Finally, conventional piezoelectric transducers tend to be fragile, expensive, and difficult to electrically connect.

A conventional electrostatic transducer utilizes a metallized polymer membrane held against a conductive backplate by a DC bias. The backplate contains depressions that create an acousto-mechanical resonance at a desired frequency of operation. An AC voltage added to the DC bias source alternately augments and subtracts from the bias, thereby adding to or subtracting from the force drawing the membrane against the backplate. While this variation has no effect where the surfaces are in contact, it causes the membrane to vibrate above the depressions. Without substantial damping the resonance peak of an electrostatic transducer is fairly sharp, resulting in efficient operation at the expense of limited bandwidth. Damping (e.g., by roughening the surface of the membrane in contact with air) will somewhat expand the bandwidth, but efficiency will suffer.

Another technique for expanding the bandwidth of an electrostatic transducer, as described in Mattila et al., *Sensors and Actuators A*, 45, 203–208 (1994), is to vary the depths of the depressions across the surface of the transducer so as to produce different resonances that sum to produce a wide bandwidth.

The maximum driving power (and the maximum DC bias) of the transducer is limited by the size of the electric field that the membrane can withstand as well as the voltage the air gap can withstand. The strongest field occurs where the membrane actually touches the backplate (i.e., outside the depressions). Because the membrane is typically a very thin polymer film, even a material with substantial dielectric strength cannot experience very high voltages without charging or punchthrough failure. Similarly, because the use of a thin film means that the metallized surface of the film will be very close to the backplate, the electric field across the film and hence the capacitance of the device is quite high, resulting in large drive-current requirements.

Piezoelectric film transducers utilize light, flexible membrane materials such as polyvinylidene fluoride (PVDF) film, which changes shape in response to an applied potential. The film can be made very light to enhance its acoustic-impedance match to the air, resulting in efficient ultrasonic transmission. In one known configuration, a PVDF film is coated on both sides with a conductive material and placed atop a perforated metal plate. The plate represents the top of an otherwise closed volume, and a vacuum applied to the volume draws the membrane into the perforations. An AC voltage source connected across the two metallized surfaces of the membrane (which act as electrodes separated by a dielectric) causes the PVDF material to expand and contract, varying the degree of dimpling into the perforations and thereby causing the generation of sound waves. In a related configuration, also known, the membrane is disposed beneath the perforated plate rather than above it, and a pressure source is substituted for the vacuum. In this version, the AC source varies the degree to which the membrane protrudes into or through the perforations, once again creating sound.

While the electro-acoustic characteristics of these transducers render them suitable for parametric applications, their practicality is questionable. It is unlikely that the vacuum or pressure can be adequately maintained for long periods in commercially realistic environments, and any slight leakage will cause the transducer to lose sensitivity and eventually fail.

SUMMARY OF THE INVENTION

In accordance with a first aspect of the present invention, the maximum power output of an ultrasonic transducer is not limited by the dielectric strength of the transducer membrane. Rather than placing the membrane directly against the surface of a conductor as in conventional devices (whereby the electric field across the membrane is very large), it is instead held against a dielectric spacer. The transmission of ultrasound does not depend on the presence of a powerful electric field. Accordingly, relatively large bias and driving voltages can be applied across the membrane and spacer without risk of failure, because the spacer substantially reduces the electric field experienced by the membrane. Moreover, because the spacer also reduces the capacitance of the transducer, the driving current requirements are correspondingly reduced, simplifying design of the power amplifier.

A sonic transducer in accordance with this aspect of the invention may include a conductive membrane, a backplate comprising at least one electrode and, disposed between the membrane and the backplate, a dielectric spacer comprising a series of depressions arranged in a pattern, the depressions forming cavities each resonant at a predetermined frequency. The depressions may take any suitable form, e.g., annular grooves arranged concentrically, a pattern of distributed cylindrical depressions, etc., and may extend partially or completely through the dielectric spacer. Moreover, the depressions may vary in depth through the spacer in order to form cavities resonant at different frequencies; a different electrode may be assigned to each set of depressions of a single depth.

In a second aspect, the invention combines both piezoelectric and electrostatic modes of operation. A sonic transducer in accordance with this aspect of the invention may comprise a substantially nonconductive piezoelectric membrane having a pair of opposed conductive surfaces, a backplate comprising at least one electrode, and means for creating a resonant cavity or structure between the membrane and the electrode(s). For example, the cavities may be formed by a dielectric spacer having depressions (such as cylindrical recesses or apertures, grooves, etc.) and disposed between the membrane and the electrode(s). A DC bias urges the membrane into the resonant cavities and an AC source, connected across the membrane, provides the driving signals.

The transducers are preferably driven with circuits in which the capacitive transducers resonate with circuit inductances at the acoustical-mechanical resonant frequencies of the transducers. This provides a very efficient transfer of electrical energy to the transducers, thereby facilitating the use of relatively high carrier frequencies. The efficiency and versatility of the transducers described herein makes them suitable for parametric as well as other ultrasonic applications such as ranging, flow detection, and nondestructive testing. In parametric applications, a plurality of transducers may be incorporated into a transducer module and the modules are arranged and/or electrically driven so as to provide, in effect, a large radiating surface and a large nonlinear interaction region.

BRIEF DESCRIPTION OF THE DRAWINGS

The invention description below refers to the accompanying drawings, of which.

DETAILED DESCRIPTION OF THE PREFERRED EMBODIMENTS

Figure 1A:
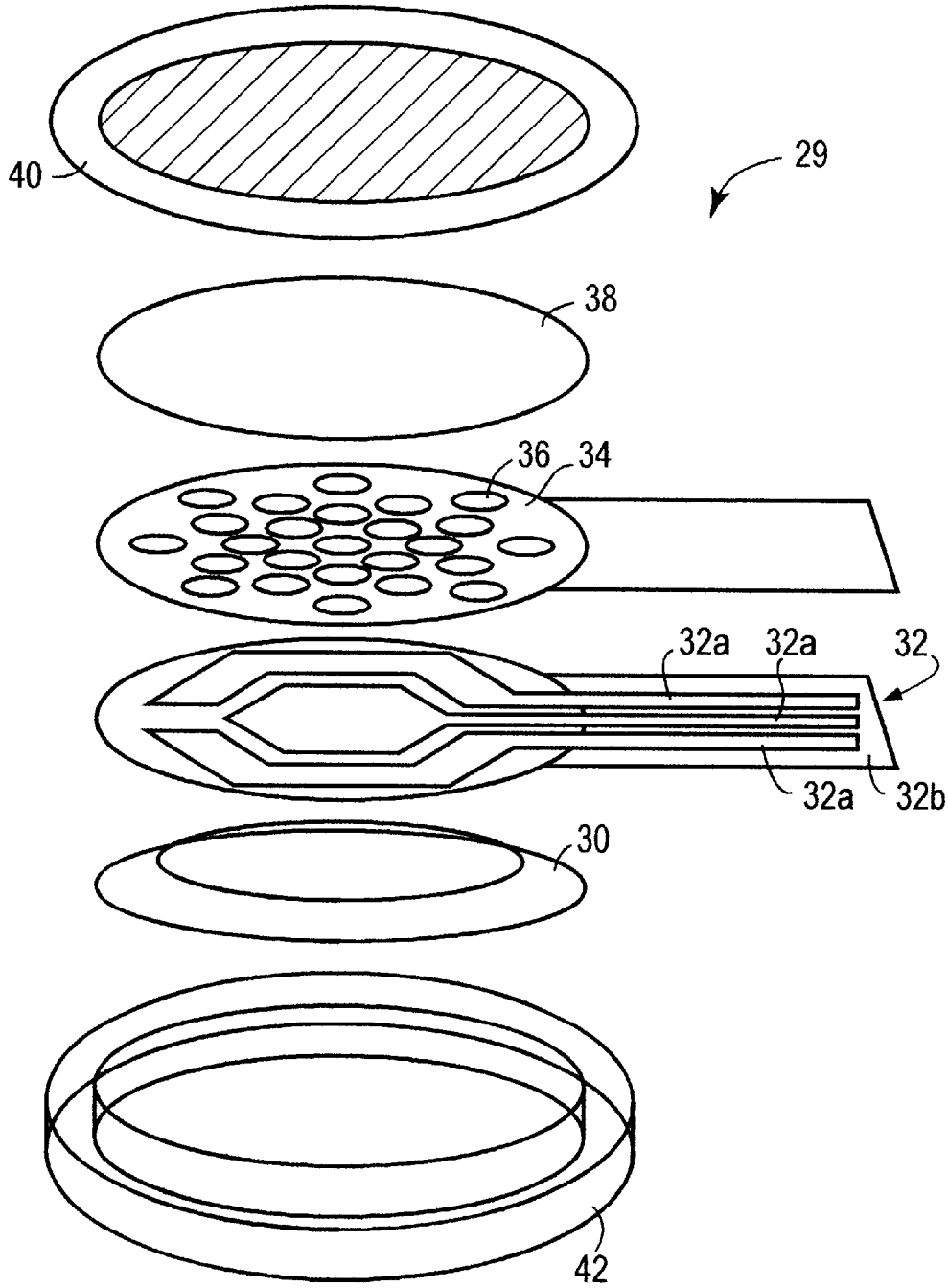
FIG. 1A is an exploded view of an electrostatic transducer module incorporating the invention.

As shown in FIG. 1A, an electrostatic transducer module 29 incorporating the invention may include a conical spring 30 that supports, in order, a conductive electrode unit 32, a dielectric spacer 34 provided with an array of apertures 36, and a metallized polymer membrane 38. The components 32–38 are compressed against the spring 30 by an upper ring 40 that bears against the film 38 and threadably engages a base member 42 that supports the spring 30. The module 29 comprises a plurality of electrostatic transducers, corresponding with the respective apertures 36 in the dieletric spacer 34. Specifically, the portion of the film 38 above each of the apertures and the portion of the electrode unit 32 beneath the aperture function as a single transducer, having a resonance characteristic that is the function, inter alia, of the tension and the area density of the film 38, the diameter of the aperture and the thickness of the polymer layer 34. A varying electric field between each portion of the membrane 38 and electrode unit 32 deflects that portion of the membrane toward or away from the electrode unit 32, the frequency of movement corresponding to the frequency of the applied field.

As illustrated, the electrode unit 32 may be divided by suitable etching techniques into separate electrodes 32*a* below the respective apertures 36, with individual leads extending from these electrodes to one or more driver units as discussed below. The module 29 is readily manufactured using conventional flexible circuit materials and therefore has a low cost; for example, spacer 34 may be a polymer such as the PYRALUX material marketed by duPont, and the membrane 38 may be a metallized MYLAR film (also marketed by duPont). If desired, drive unit components can placed directly on the same substrate, e.g., the tab portion 32*b*. The structure is light in weight and can be flexible for easy deployment, focusing and/or steering in an array configuration.

Figure 1B:
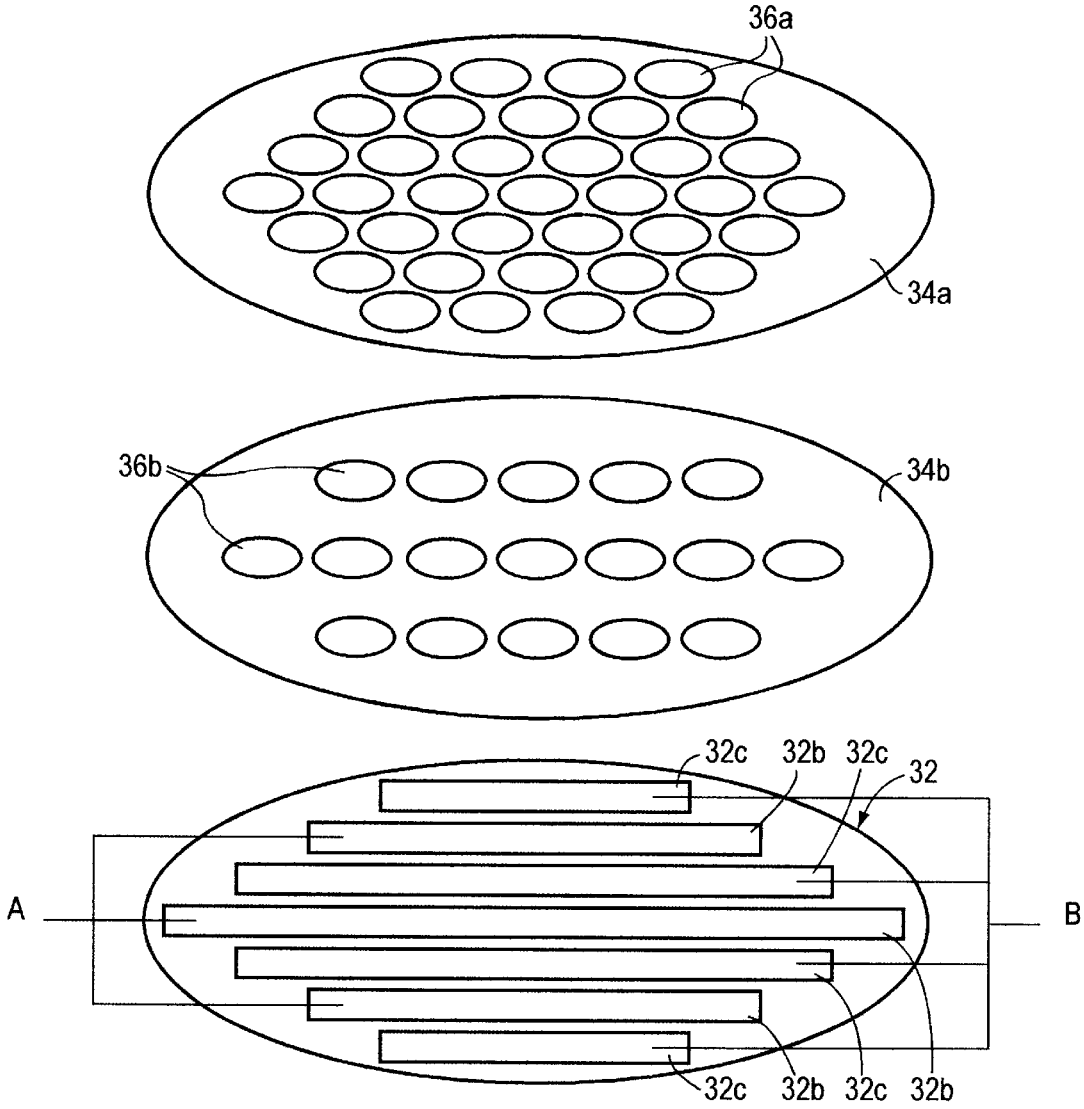
FIG. 1B depicts a modification of the transducer module of FIG. 1A, configured for multiple-resonant-frequency operation.

It will be appreciated that geometries, in particular the depths of the apertures 36, may vary so that the resonance characteristics of the individual transducers in the module 29 span a desired frequency range, thereby broadening the overall response of the module as compared with that of a single transducer or an array of transducers having a single acousto-mechanical resonance frequency. This can be accomplished, as shown in FIG. 1B, by using a dielectric spacer 34 that comprises two (or more) layers 34*a* and 34*b*. The upper layer 34*a* has a full complement of apertures 36*a*. The lower layer 34*b*, on the other hand, has a set of apertures 36*b* that register with only selected ones of the apertures 36*a* in the layer 34*a*. Accordingly, where two apertures 36*a*, 36*b* register, the aperture depth is greater than that of an aperture in the layer 34*a* above an unapertured portion of the layer 34*b*. The electrode unit 32 has electrodes 32*b* beneath the apertures in the layer 34*b* and electrodes 32*c* beneath only the apertures in the layer 34*a*. This provides a first set of transducers having higher resonance frequencies (shallower apertures) and a second set having lower resonance frequencies (deeper apertures). Other processes, such as screen printing or etching, can also produce these geometries.

Figure 2A:
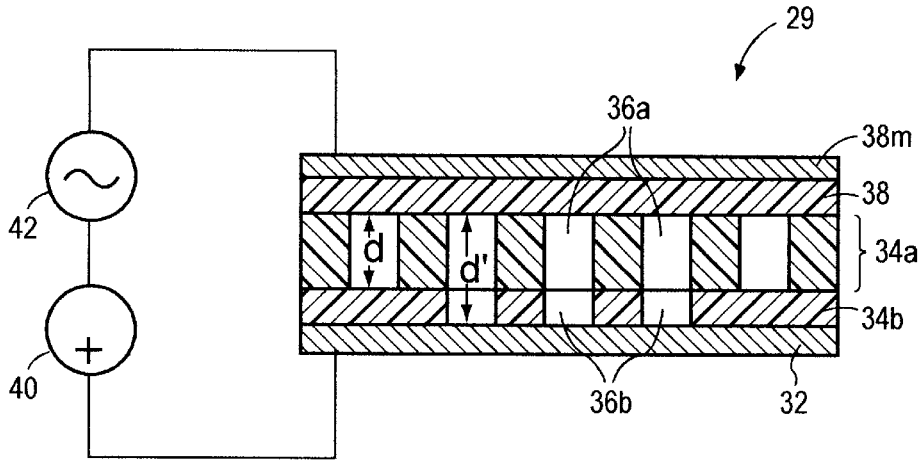
FIGS. 2A and 2B are partially schematic side elevations illustrating different modes of constructing and operating the transducer modules shown in FIGS. 1A and 1B.
Figure 2B:
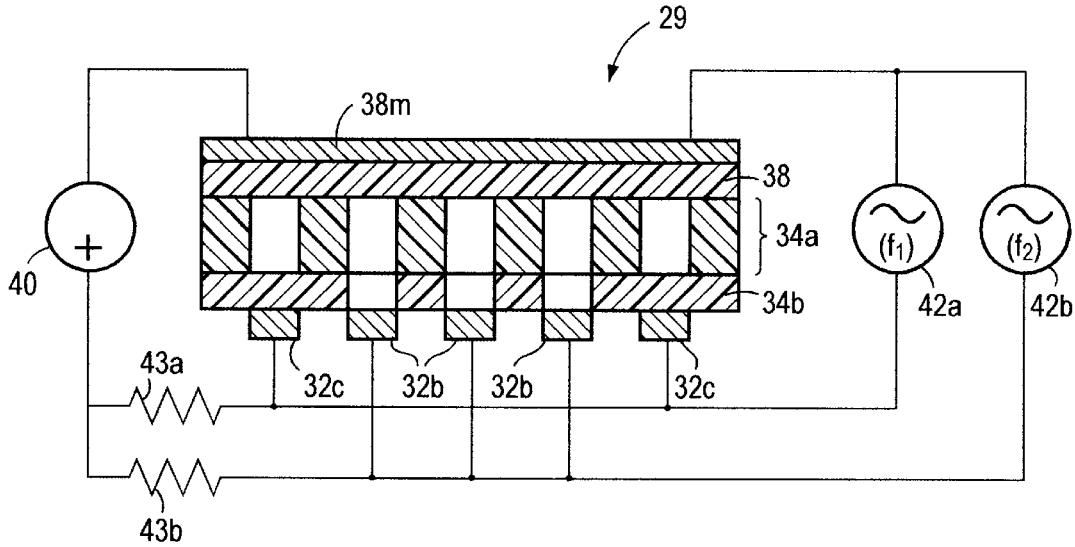

Different modes of construction and operation of the module 29 are illustrated in FIGS. 2A and 2B. In FIG. 2A, module 29 has a single electrode 32, and the cavities formed by layers 34*a*, 34*b* have different depths d, d' depending on whether an aperture 36*a* is registered with an aperture 36*b*; not shown is structure urging the membrane 38 against spacer 34. A DC bias source 40 added to an AC source 42

(which produces the modulated signal for transmission) are connected across the module 29, i.e., to electrode 32 and the metallized surface 38in of membrane 38. Although the same signal is applied to all cavities 36, their different resonance peaks broaden the bandwidth of the module 29 as a whole.

Alternatively, as shown in FIG. 2B, the different sets of electrodes 32*b*, 32*c* may each be connected to a different source 42*a*, 42*b* of AC driving signals. Each signal source 42*a*, 42*b* is electrically resonant at the mechanical resonance frequency $f_1$, $f_2$ of the cavities it drives. This "segregated multiresonance" arrangement optimizes response and maximizes power transfer by pairing each set of resonance cavities with an amplifier tuned thereto. The resistors 43*a*, 43*b* isolate electrodes 32*b*, 32*c* while allowing DC to pass through them. (Inductors could be used instead.)

It is also possible to vary not just the acousto-mechanical resonance properties of the transducer as described above, but the electrical resonance properties as well. For example, the capacitance of different areas of the transducer 29 can be varied (e.g., by using materials of different dielectric constant for different regions of spacers 34*a*, 34*b*) to produce multiple, electrical resonance circuits. The electrical resonance affects the efficiency of power transfer from the amplifier (i.e., the more closely the transducer impedance matches that of the amplifier, the more output power will coupled into the transducer with concomitant reduction in current draw), so varying electrical resonance within a single transducer—regardless of whether mechanical resonance is also varied—an be employed to broaden the tolerance of the transducer to different amplifier configurations.

Figure 2C:
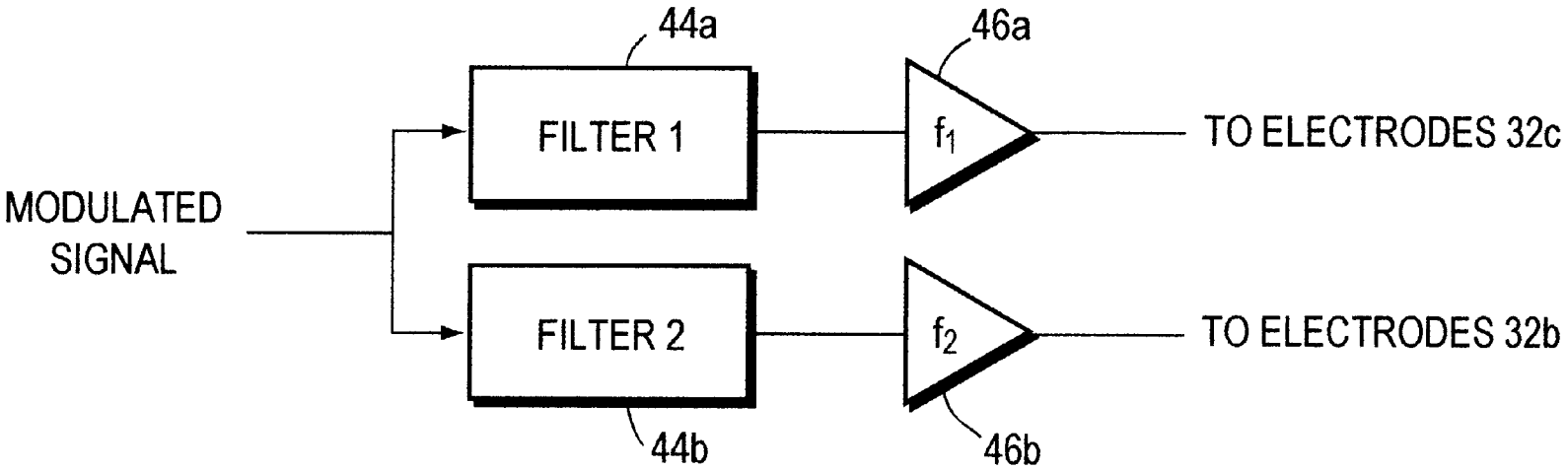
FIG. 2C schematically depicts a drive circuit for the embodiment shown in FIG. 2B.

Signal sources 42*a*, 42*b* can be realized as shown in FIG. 2C. The modulated output signal is fed to a pair of filters 44*a*, 44*b*, which split the signal into different frequency bands and distribute these to a pair of tuned amplifiers 46*a*, 46*b*. Amplifier 46*a* is tuned to $f_1$—i.e., the inductance of amplifier 46*a* in series with the measured capacitance across the cavities to which amplifier 46*a* is connected results in an electrical resonance frequency equal to the mechanical resonance frequency of those cavities—and amplifier 46*b* is tuned to $f_2$. Filters 44*a*, 44*b* may be bandpass filters or a lowpass and a highpass filter that partition the modulated signal between $f_1$ and $f_2$.

The resonance cavities of module 29 need not be of circular cross-section as illustrated. Instead, they may have a different cross-section (e.g., square, rectangular, or other polygonal shape), or may take the form of annular grooves (square, V-shaped, rounded, etc.) arranged concentrically on spacer 34, or have other volumetric shapes appropriate to the chosen application (or desired method of manufacture). Backplate electrodes for driving concentrically grooved transducer arrangements are shown in FIGS. 3A and 3B, where the conductive pattern of the electrode units 52 comprises rings 53, 55 and 57 so that grooves of different depths may be individually driven. The spacings of the rings and the relative phases of the applied signals can be selected so as to shape the ultrasonic beams projected from the transducer modules.

The proper groove depth for a desired frequency of operation is straightforwardly obtained without undue experimentation. For a film of area density $\sigma$ (kg/m$^2$) and a square groove of depth h (m), the resonance frequency $f_0$ may be expected to exist at $$f_0 = \frac{c}{2\pi}\sqrt{\frac{\rho_0}{h\sigma}}$$

where c is the speed of sound in air and $\rho_0$ is the density of air. (For a non-square groove, the formula is similar.) The resonant frequency is also affected by the membrane tension, groove width, and DC bias. Thus, for a transducer having a resonance frequency of 65 kHz based on a film having an area density of $\sigma$=0.0113 kg/m$^2$, the hole/feature depth h is 74 $\mu$m (3 mils). If this cavity depth produces a capacitance of, for example, 500 pF, an inductance (typically the secondary of a transformer) of 12 mH is chosen to achieve 65 kHz resonance.

For this transducer, a reasonable bandwidth for efficient driving is 10 kHz (i.e., is 60–70 kHz). It may therefore be desirable to employ a second set of transducers with a 75 kHz resonance frequency to widen the useful output bandwidth. Using the same design approach, achieving a 75 kHz resonance requires a 56 $\mu$m (2 mil) feature depth.

Figure 3C:
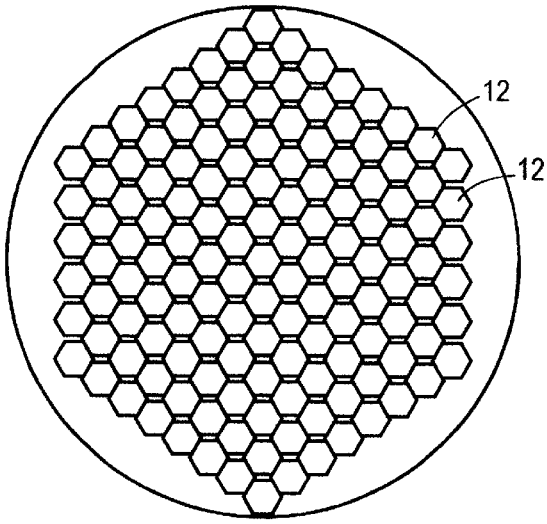
FIGS. 3C and 3D illustrate representative arrays of transducer modules.
Figure 3A:
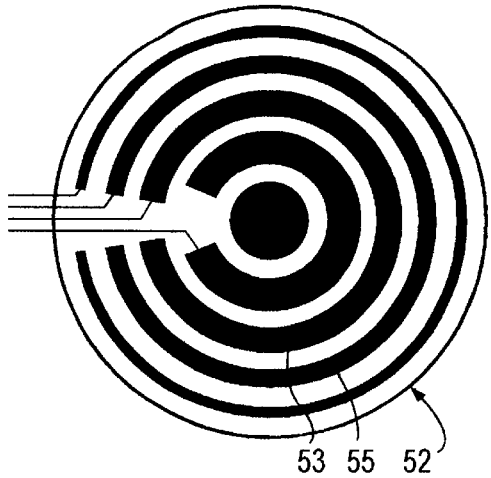
FIGS. 3A and 3B illustrate representative electrode arrangements.
Figure 3D:
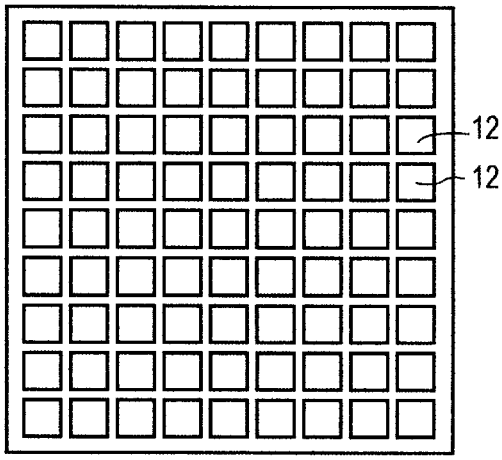
Figure 3B:
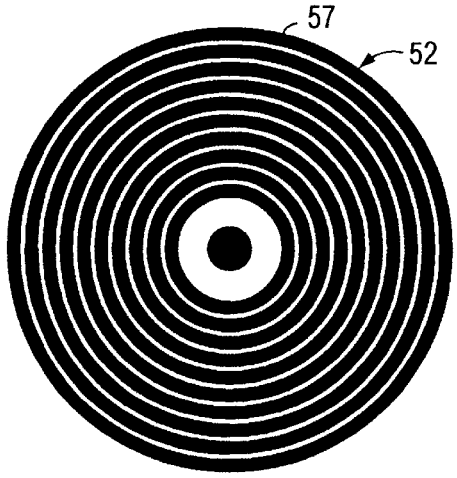

FIGS. 3C and 3D illustrate arrays of transducer modules in which the modules have alternative configurations. In FIG. 3C, each of the modules has a hexagonal horzontal outline, which provides close packing of the modules. In FIG. 3D the modules have a square configuration, which also permits close packing. The patterns are well-suited for multiple-beam generation and phased-array beam steering. It should be noted that, in all of the foregoing transducer embodiments, any electrical crosstalk among electrodes can be mitigated by placing so-called "guard tracks" between the power electrodes. It should also be appreciated that transducers having multiple electrical (but not necessarily acousto-mechanical) resonances can be employed to increase the efficiency of amplification over a wide bandwidth.

Figure 4A:
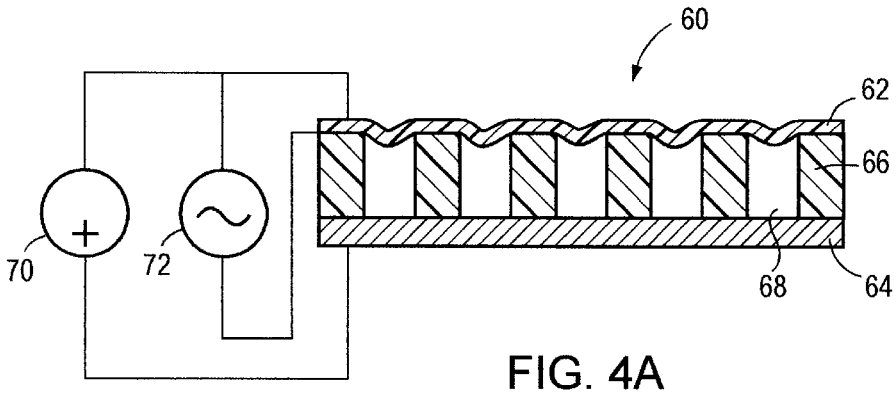
FIG. 4A is a partially schematic side elevation of a hybrid transducer employing a piezoelectric drive with DC bias and resonance.

The foregoing transducer embodiments are electrostatic in nature. It is possible to utilize the approach of a dielectric spacer in conjunction with a piezoelectric membrane as shown in FIG. 4A. In this case, the transducer module 60 includes a piezoelectric (e.g., PVDF) membrane 62, a conductive backplate 64, and a dielectric spacer 66 with apertures 68 therethrough that form resonance cavities. Once again, the cavities 68 may be of varying rather than unitary depth, and backplate 64 may comprise a series of electrodes matched to different ones of the cavities 68.

Membrane 62 is preferably dielectric in nature and metallized on both top and bottom surfaces thereof. A DC bias, provided by a circuit 70, is connected between the backplate 64 and the conductive top surface of membrane 62, thereby urging the membrane into the cavities 68. This provides a reliable mechanical bias for the membrane 62 so that it can function linearly to generate acoustical signals in response to the electrical outputs of the drive circuit 72, which is connected across the membrane 62 in the manner of conventional piezo transducer drives. Consequently, the membrane is held in place by electrostatic forces but driven piezoelectrically. As described above, DC bias circuit 70 can include components that isolate it from the AC drive circuit 72.

Alternatively, it is possible to utilize mechanical forms of membrane disdplacement to substitute for or augment the DC bias. For example, the membrane may be formed or mechanically tensioned so as to be drawn it into cavities 68; the piezoelectrically induced contractions and dilations move the biased film to create sonic signals.

Figure 4B:
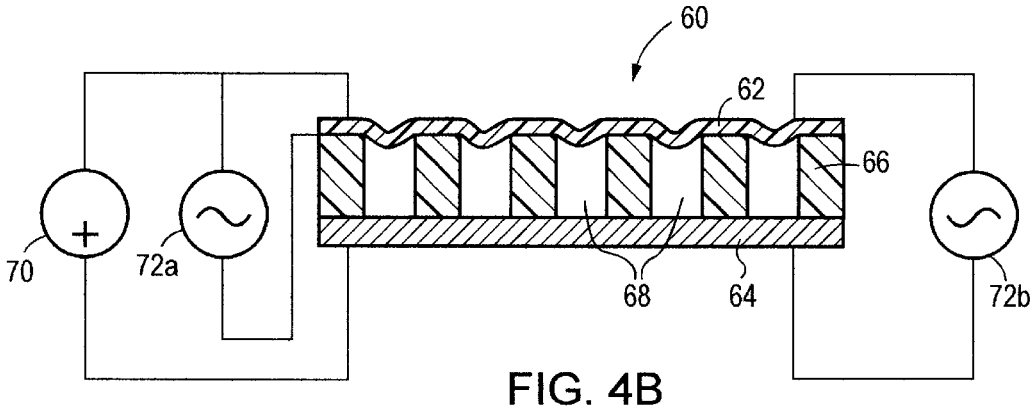
FIG. 4B is a partially schematic side elevation of a hybrid transducer driven both electrostatically and piezoelectrically.

As shown in FIG. 4B, it is possible to utilize separate piezo and electrostatic drivers. Thus, while a piezo driver 72*a* is connected across membrane 62 as discussed above, an electrostatic driver 72*b* is connected, like DC bias circuit 70, between the metallized top surface of membrane 62 and backplate 64. As a result, piezoelectric and electrostatic forces are used in conjunction to drive membrane 62. Depending on the orientation of membrane 62, drivers 72*a*, 72*b* may be driven in phase or out of phase (so the forces reinforce rather than oppose each other). Thus, on the positive swing of the drive voltage produced by AC source 72*a*, electrostatic forces attract membrane 62 toward the backplate 64 (which is preferably maintained at the high DC bias voltage as indicated in the figure), and simultaneously, piezo drive 72*b* causes membrane 62 to expand and thin; as the voltage produced by driver 72*a* goes negative, the electrostatic attraction force weakens, and piezo driver 72*b* assists this process by causing membrane 62 to contract and thicken.

Conversely, it is possible to operate the piezoelectric and electrostatic drivers so that the forces deliberately counteract rather than reinforce each other, e.g., to inactivate selected portions of the transducer for signal steering purposes.

Figure 4C:
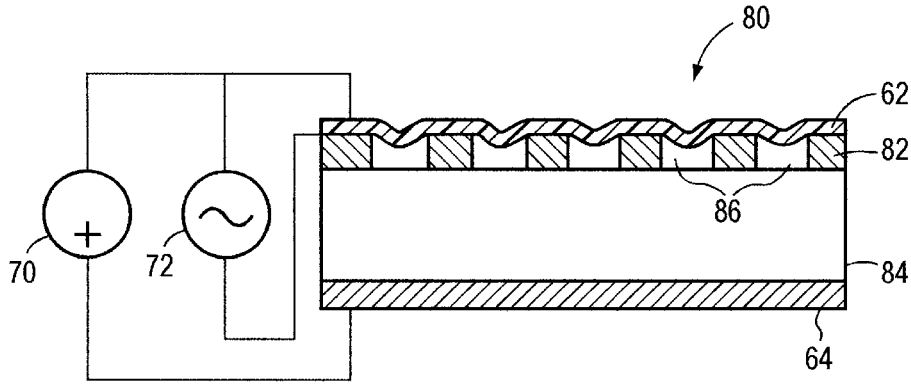
FIG. 4C is an improved piezoelectric transducer design.

In another embodiment, illustrated in FIG. 4C, an electric field is used to replace the vacuum employed in prior-art devices to draw the membrane through perforations toward the backplate. The transducer module 80 in FIG. 4C includes a piezoelectric membrane 62 metallized on top and bottom surfaces and in contact with a perforated top plate 82 (which may be conductive or non-conductive). As in conventional transducer modules, top plate 82 is spaced above backplate 64 by a side wall 84. A DC bias, provided by circuit 70, is connected between backplate 64 and the conductive surface of membrane 62, thereby urging membrane 62 into the apertures 86 in the plate 82. This provides a reliable mechanical bias for the membrane 62 so that it can function linearly to generate acoustical signals in response to the electrical outputs of the piezo drive circuit 72.

The structure shown in FIG. 4A can be further simplified by using a conductive, grooved (e.g., V-grooved) metal backplate rather than the illustrated spacer and backplate. In this case, the grooves serve the same function as the spacer gaps, with the DC-biased backplate (or mechanical formation as discussed above) drawing membrane 62 into the grooves.

It should be stressed that all of the foregoing transducer embodiments can be used for reception as well as transmission, and that it is frequently possible to mount drive and related circuitry directly onto the transducer substrate.

It will therefore be seen that I have developed improved ultrasonic transducers that obviate limitations found in the prior art. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A sonic transducer comprising:

(a) a conductive membrane;

(b) a backplate comprising at least one electrode; and (c) disposed between the membrane and the backplate, a dielectric spacer comprising a series of depressions arranged in a pattern, the depressions forming cavities each resonant at a predetermined frequency, wherein (d) the backplate comprises a plurality of electrodes and the depressions vary in depth through the spacer, depressions of different depths forming cavities resonant at different frequencies, different ones of the electrodes being aligned with depressions having a consistent depth; and (e) the depressions of varying depth facilitate wide operational bandwidth at least over ultrasound frequencies such that generation, by the membrane, of ultrasound modulated with an audio signal is demodulated as it passes through the atmosphere to thereby create a highly directional audible sound.

2. The transducer of claim 1 wherein at least some of the depressions extend completely through the spacer.

3. The transducer of claim 1 wherein the depressions are annular grooves arranged concentrically.

4. The transducer of claim 1 wherein the depressions have a circular or polygonal cross section.

5. The transducer of claim 1 further comprising means for urging the backplate, the spacer, and the conductive membrane into intimate contact.

6. The transducer of claim 1 wherein the conductive membrane is a polymer film metallized on at least one side thereof.

7. The transducer of claim 6 wherein the conductive membrane has first and second opposed surfaces, the first surface being metallized and in contact with the spacer, none of the depressions extending fully through the spacer.

8. The transducer of claim 1 wherein the conductive membrane comprises a nonconductive piezoelectric material sandwiched between first and second metallized surfaces.

9. The transducer of claim 8 wherein the first metallized surface is in contact with the spacer and further comprising:

(a) a DC source connected across the second metallized surface of the membrane and the at least one backplate electrode; and (b) an AC source connected across the first and second metallized surfaces of the membrane for driving the membrane piezoelectrically.

10. The transducer of claim 9 further comprising an AC source connected across the second metallized surface of the membrane and the at least one backplate electrode for driving the membrane electrostatically in mutually reinforcing conjunction with the piezoelectric AC source.

11. A sonic transducer comprising:

(a) a conductive membrane;

(b) a backplate comprising at least one electrode; and (c) disposed between the membrane and the backplate, a dielectric spacer comprising a series of depressions arranged in a pattern, the depressions forming cavities each resonant at a predetermined frequency, wherein (d) the backplate comprises a plurality of electrodes and the depressions vary in depth through the spacer, depressions of different depths forming cavities resonant at different frequencies, different ones of the electrodes being aligned with depressions having a consistent depth; and (e) the spacer comprises at least first and second contiguous layers, the depressions extending fully through the first layer, the second layer comprising a second series of depressions fewer in number than the the depressions of the first layer, the depressions of the second layer registering with depressions of the first layer to form a first series of resonant cavities, the depressions of the first layer not registered with second-layer depressions forming a second series of resonant cavities, the first and second series of cavities having different resonant frequencies.

12. A sonic transducer comprising:

(a) a conductive membrane;

(b) a backplate comprising at least one electrode; and (c) disposed between the membrane and the backplate, a dielectric spacer comprising a series of depressions arranged in a pattern, the depressions forming cavities each resonant at a predetermined frequency, wherein (d) the conductive membrane is a polymer film metallized on at least one side thereof; and (e) the conductive membrane has first and second opposed surfaces, the first surface being unmetallized and in contact with the spacer, the second surface being metallized.

13. A sonic transducer comprising:

(a) a conductive membrane;

(b) a backplate comprising at least one electrode; and (c) disposed between the membrane and the backplate, a dielectric spacer comprising a series of depressions arranged in a pattern, the depressions forming cavities each resonant at a predetermined frequency, wherein (d) the backplate comprises a plurality of electrodes and the depressions vary in depth through the spacer, depressions of different depths forming cavities resonant at different frequencies, different ones of the electrodes being aligned with depressions having a consistent depth; and (e) the depressions of different depths form cavities having different mechanical resonance frequencies, the transducer further comprising, for each different depression depth, a separate resonant drive circuit tuned to the corresponding mechanical resonant frequency.

14. The transducer of claim 13 wherein the transducer has a capacitance and each drive circuit includes an inductor coupled with the transducer capacitance to provide an electrical resonance corresponding to the mechanical resonance frequency.

15. A sonic transducer comprising:

(a) a dielectric spacer having a pair of opposed surfaces and a series of apertures extending therethrough, the apertures being arranged in a pattern;

(b) a backplate comprising at least one electrode conforming to the aperture pattern and means for coupling an AC signal to the at least one electrode, the backplate being disposed against a first surface of the spacer;

(c) a conductive membrane disposed against a second surface of the membrane; and (d) means for urging the backplate and the conductive membrane into intimate contact with the first and second surfaces of the spacer, the apertures forming cavities each resonant at a predetermined frequency, wherein (e) the backplate comprises a plurality of electrodes and the depressions vary in depth through the spacer depressions of different depths forming cavities resonant at different frequencies, different ones of the electrodes being aligned with depressions having a consistent depth; and (f) the depressions of varying depth facilitate wide operational bandwidth at least over ultrasound frequencies such that generation, by the membrane in response to the AC signal, of ultrasound modulated with an audio signal is demodulated as it passes through the atmosphere to thereby create a highly directional audible sound.

16. A sonic transducer comprising:

(a) a substantially nonconductive piezoelectric membrane having a pair of opposed conductive surfaces;

(b) a backplate comprising at least one electrode;

(c) means for creating a plurality of resonant cavities between the membrane and the at least one electrode;

(d) means for urging the membrane into the resonant cavities; and (e) an AC source connected across the membrane, wherein (f) the backplate comprises a plurality of electrodes and the depressions vary in depth through the spacer, depressions of different depths forming cavities resonant at different frequencies, different ones of the electrodes being aligned with depressions having a consistent depth; and (g) the depressions of varying depth facilitate wide operational bandwidth over ultrasound frequencies such that generation, by the membrane in response to the AC source, of ultrasound modulated with an audio signal is demodulated as it passes through the atmosphere to thereby create a highly directional audible sound.

17. The transducer of claim 16 wherein the means for creating a plurality of resonant cavities comprises a perforated plate spaced above the at least one electrode.

18. A method of driving a sonic transducer comprising (a) a conductive membrane, (b) a backplate comprising at least one electrode, and (c) disposed between the membrane and the backplate, a dielectric spacer comprising a series of depressions arranged in a pattern, the depressions forming cavities each resonant at a predetermined frequency, wherein the backplate comprises a plurality of electrodes and the depressions vary in depth through the spacer, depressions of different depths forming cavities resonant at different frequencies, different ones of the electrodes being aligned with depressions having a consistent depth, the method comprising the steps of:

(a) for each different depression depth, providing a separate resonant drive circuit tuned to the corresponding mechanical resonant frequency; and (b) driving the cavities with the respective drive circuits tuned thereto.

19. The method of claim 18 wherein the transducer has a capacitance and each drive circuit includes an inductor coupled with the transducer capacitance to provide an electrical resonance corresponding to the mechanical resonance frequency.

20. A method of operating a sonic transducer comprising a sonic transducer comprising (a) a conductive membrane, (b) a backplate comprising at least one electrode, and (c) disposed between the membrane and the backplate, a dielectric spacer comprising a series of depressions arranged in a pattern, the depressions forming cavities each resonant at a predetermined frequency, wherein the backplate comprises a plurality of electrodes and the depressions vary in depth through the spacer, depressions of different depths forming cavities resonant at different frequencies, different ones of the electrodes being aligned with depressions having a consistent depth, the method comprising the steps of driving the transducer to generate ultrasound modulated with an audio signal such that the generated ultrasound is demodulated as it passes through the atmosphere to thereby create a highly directional audible sound.

* * * * *